US006366752B1

(12) United States Patent
Weber

(10) Patent No.: US 6,366,752 B1
(45) Date of Patent: Apr. 2, 2002

(54) SPHERICAL SILICONE ADDITIVE FOR REDUCED PHOTO RECEPTOR DRAG AND WEAR

(75) Inventor: Ralph Johannes Weber, Victor, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/635,493

(22) Filed: Aug. 9, 2000

(51) Int. Cl.[7] ..... G03G 15/00
(52) U.S. Cl. ..... 399/162; 430/69; 399/164
(58) Field of Search ..... 430/69; 399/159, 399/164, 350, 162

(56) References Cited

U.S. PATENT DOCUMENTS

| | | | | |
|---|---|---|---|---|
| 4,340,658 A | | 7/1982 | Inoue et al. | |
| 4,388,392 A | | 6/1983 | Kato et al. | |
| 4,519,698 A | | 5/1985 | Kohyama et al. | |
| 4,766,048 A | * | 8/1988 | Hisamura | 430/58 |
| 5,021,309 A | | 6/1991 | Yu | |
| 5,069,993 A | | 12/1991 | Robinette et al. | |
| 5,213,928 A | | 5/1993 | Yu | |
| 5,368,967 A | | 11/1994 | Schank et al. | |
| 5,480,715 A | | 1/1996 | Mills et al. | |
| 5,709,974 A | | 1/1998 | Yuh et al. | |
| 5,721,085 A | | 2/1998 | Oshiba et al. | |
| 5,725,983 A | | 3/1998 | Yu | |
| 5,732,320 A | | 3/1998 | Domagall et al. | |
| 5,753,401 A | * | 5/1998 | Woytek et al. | 430/69 |
| 5,819,147 A | | 10/1998 | Shoji | |
| 5,994,014 A | * | 11/1999 | Hinch et al. | 430/66 |
| 6,071,662 A | | 6/2000 | Carmichael et al. | |

OTHER PUBLICATIONS

Product Literature for "SR340 Silicone Resin Series," General Electric Company, 1993.
Product Literature for "Silicone Resin Fine Particles TOSPEARL," Toshiba Silicone Co., Ltd., Dec. 1990.

* cited by examiner

*Primary Examiner*—Christopher Rodee
(74) *Attorney, Agent, or Firm*—Oliff & Berridge, PLC

(57) ABSTRACT

A spherical silicone additive is selected and introduced into a contact region between a photoreceptor's anti-curl layer and an electrophotographic system's backer bar, and into a bulk material of the electrophotographic system's spots blade. The additive reduces frictional drag and wear at the contact region between the anti-curl layer and the backer bar and at a contact region between a photoreceptor's outermost surface and the system's spots blade. The reduction of photoreceptor drag and wear at the above contact regions reduces photoreceptor surface irregularities, excessive backer bar wear, excessive spots blade wear, belt ripple and belt contamination. As a result, system drive torque requirements may be minimized, the life of the contacting system components may be extended and system performance may be improved.

7 Claims, 2 Drawing Sheets

SPHERICAL SILICONE ADDITIVE FOR REDUCED PHOTO RECEPTOR DRAG AND WEAR

BACKGROUND OF THE INVENTION

1. Field of Invention

This invention relates in general to electrophotographic imaging systems and, more specifically to imaging systems wherein component parts thereof include spherical silicone additives to reduce photoreceptor drag and wear.

2. Description of Related Art

Conventional electrophotographic and electrostatographic imaging systems include photosensitive members, i.e., photoreceptors, that are commonly used in electrophotographic or electrostatographic (Xerographic) processes in either a flexible belt or a rigid drum configuration. The flexible belt can be either seamless or seamed. Photoreceptors generally comprise a photoconductive layer formed on an electrically conductive substrate. The photoconductive layer acts as an insulator in the dark so that electric charges are retained on its surface. When exposed to light the charge dissipates.

A latent image is generally formed on the photoreceptor by first uniformly depositing an electric charge over the surface of the photoconductive layer using one of several methods well known in the art. The photoconductive layer acts as a charge storage capacitor with a charge on its free surface and an equal charge of opposite polarity (the counter charge) on the conductive substrate. A light image is then projected onto the photoconductive layer. On the portions of the photoconductive layer that are exposed to light, the electric charge conducts through the layer and reduces the surface charge. The portions of the surface of the photoconductor that are not exposed to light retain their surface charge. The quantity of electric charge at any particular point on the photoconductive surface is inversely related to the illumination incident thereon, thus forming an electrostatic latent image.

The photodischarge of the photoconductive layer requires that the layer photogenerate a conductive charge and generate and transport this charge through the layer thereby neutralizing the charge on the surface. Two types of photoreceptor structures have been commonly used: multilayer structures wherein separate layers perform the functions of charge generation and charge transport, respectively, and single layer photoconductors that perform both functions. These layers are formed on an electrically conductive substrate and may include an optional charge blocking adhesive layer between the conductive layer and the photoconducting layer or layers. Additionally, the substrate may comprise a non-conducting mechanical support with a conductive surface. Other layers for providing special functions such as incoherent reflection of laser light, dot patterns for pictorial imaging or subbing layers to provide chemical sealing and/or a smooth coating surface may be optionally employed.

As more advanced, higher speed electrophotographic copiers, duplicators and printers have been developed, degradation of image quality has been encountered during extended cycling. During extended cycling, a photoreceptor's imaging properties degrade as a result of the photoreceptor's continuous exposure to abrasion, chemical attack, heat and light. Degradation due to cycling is particularly common among multilayered organic photoconductors that use organic film forming polymers and small molecule, low ionization donor material in the charge transport layers.

Such wear is further accelerated when the photoreceptor is used in systems that employ abrasive development systems such as single component development systems. Wear is an even greater problem where a drum is used that has such a small diameter that it must rotate many times merely to form a single image for conventional 8.5 inch by 11 inch sized documents. Wear of the photoreceptor can be compensated for by increasing the thickness of the charge transport layer. However, a large increase in charge transport layer thickness can make a photoreceptor inoperable at high imaging process speeds because of the very long transit times of common charge transport layer materials. Also, large decreases in the thickness due to wear can cause dramatic changes in electrical characteristics in only a few thousand cycles that cannot be readily compensated for even with sophisticated computerized control apparatus.

In many of today's high volume, high precision electrophotographic imaging systems, extended cycling causes adherent spots to form on the photoreceptor's surface. To prevent imaging defects that can occur as a result of these adherent spots, many modem electrophotographic systems include a spots blade. The function of a spots blade is to remove adherent spots from the surface of the photoreceptor. Conventional cleaning blades work in a similar manner; however, the primary function of a cleaning blade is to remove toner from the photoreceptor's surfaces.

Spots blades are generally oriented either in a doctor mode or a wiper mode. Unfortunately, because intimate contact between the spots blade and the photoreceptor's surface is necessary in order to remove the adherent spots, the spots blade often imparts drag to the system that results in higher torque requirements for driving the photoreceptor.

In addition to the frictional wear encountered at the photoreceptor's outermost layer, another problem encountered when one or more photoconductive layers are applied to a flexible supporting substrate is curling of the photoconductive member. To counteract the curling tendency, imaging engineers have applied coatings to the side of the supporting substrate opposite the photoconductive layers. These coatings, or layers formed by the coatings, are generally referred to as anti-curl layers, backing layers, or anti-curl backing layers. However, difficulties with these anti-curl layers have been encountered. For example, photoreceptor curl can occur in as few as 1,500 imaging cycles under the stressful conditions of high temperature and humidity. Moreover, engineers have found that during the cycling of the photoconductive member, relatively rapid wear of the anti-curl coating causes the photoconductive imaging member to curl. In some tests the anti-curl coating became completely removed in 150,000 to 200,000 cycles. This wear problem becomes even more pronounced when photoconductive members in the form of belts or webs are supported in part by backer bars or stationary guide surfaces that cause the anti-curl layer to wear away very rapidly, producing debris that scatters and deposits on critical machine components, such as lenses, corona charging devices and the like, thereby adversely affecting machine performance.

Also, the anti-curl coatings occasionally separate from the substrate during extended cycling and render the photoconductive imaging member unacceptable for forming quality images. It has also been found that when long webs of a flexible photoconductor having an anti-curl coating on one side of a supporting substrate and a photoconductive layer on the opposite side of the substrate are rolled into large rolls, dimples and creases form on the photoconductive layer that result in print defects in the final developed images.

Furthermore, when the webs are formed into belts, segments of the outer surface of the anti-curl layer in contact with each other during shipping or storage at elevated temperatures also cause creases and dimples to form that are seen as undesirable aberrations in the final printed images. Expensive and elaborate packaging is necessary to prevent the anti-curl coating from contacting itself. Additional difficulties have been encountered in continuous coating machines during the winter manufacturing of coated photoconductive imaging members because of occasional seizing that prevents transport of the coated web through the machine for downstream coating.

Numerous attempts have been made to reduce frictional damage to electrophotographic imaging system photoreceptors. Unfortunately, each solution often leads to additional problems. Moreover, since most of the solutions are aimed at reducing friction between the photoreceptor's outermost surface and the imaging system's cleaning blade, many of these solutions do not provide a way to reduce frictional damage caused by interaction with a system's spots blade or frictional damage occurring at the photoreceptor's backside anti-curl layer.

For instance, one solution includes adding a lubricant such as wax to the toner. However, the problem with this approach is that the fixability of the toner can degrade the toner's electrical function, or further filming can occur causing poor image quality.

In other attempts to reduce frictional damage, efforts have been made to reduce frictional forces by applying a lubricant to the outer surface of the photoreceptor. For instance, U.S. Pat. No. 5,721,085 to Oshiba et al. discloses a method for incorporating a lubricating substance on a photoreceptor's outermost surface. Although this approach is effective in reducing frictional forces encountered at the photoreceptor's outermost surface, the solution does not address frictional forces encountered at the photoreceptor's anti-curl layer.

Others have attempted to reduce photoreceptor drag and wear by adding a lubricant to an eletrophotographic imaging system's cleaning blade. U.S. Pat. No. 4,519,698 to Kohyama et al., for instance, discloses a method in which a waxy lubricant is used to continuously lubricate a cleaning blade. However, the problem with this solution is that the thickness of the lubricant film that forms on the photosensitive drum is difficult to maintain, and interference with the electrostatic characteristics of the photosensitive member occurs. U.S. Pat. No. 5,819,147 to Shoji, discloses an image forming apparatus that uses a silicone resin lubricant deposited at a contact region between an image bearing member and a cleaning blade. Again, while this solution effectively reduces frictional forces between the cleaning blade and the photoreceptor's outer surface, and might also be useful in reducing friction between the photoreceptor and a spots blade, it does not address frictional damage to the photoreceptor's anti-curl layer.

Attempts have also been made to reduce photoreceptor wear by constructing cleaning blades out of materials having a low coefficient of friction. However, these attempts have been plagued by the degradation of other important system characteristics, especially mechanical strength, due to the presence of additives.

According to U.S. Pat. No. 4,340,658 to Inoue et al. and U.S. Pat. No. 4,388,392 to Kato et al., surface smoothness of a photosensitive layer can be improved by adding a leveling agent such as polydimethylsiloxane to a polyvinyl carbazole type photoconductor.

In addition, when attempts have been made to reduce friction by spraying conventional silicone oil onto the imaging surface of a charge transport layer, it has been discovered that the charge transport layer cracked when bent, even without being cycled.

Photoreceptors containing trace quantities of silicone oil are also generally known in the art. Engineers have used trace quantities of silicone oil to improve surface properties of the dried film and to improve out flow during the coating process. The quantity of silicone oil used in these processes is too small to affect the bulk properties of the dried film. However, because silicone oil is quickly removed during normal abrasive wear due to toner, cleaning blades, brushes, paper contact and other frictional forces encountered during processing, any lubricating effect of silicone oil on a photoreceptor's surface is short lived.

Thus, it is desirable to increase the durability and to extend the life of the exposed surfaces of a photoreceptor, as well as to reduce the frictional contact between the components of an electrophotographic imaging system while maintaining electrical and mechanical integrity and print quality.

SUMMARY OF THE INVENTION

The present invention is directed to use of silicone additives, particularly a spherical silicone additive, to reduce photoreceptor drag and wear. More specifically, the invention is directed to introducing such an additive into a contact region between a backside anti-curl layer of the photoreceptor and an electrophotographic imaging system's backer bar or other components, and/or contact regions between an outermost layer of the photoreceptor and an electrophotographic imaging system's spots blade.

First, to reduce photoreceptor drag and wear at a contact region between a photoreceptor's anti-curl layer and an electrophotographic system's backer bar, a small amount of silicone additive can be applied to a photoreceptor's anti-curl layer surface and/or backer bar surface. Because of the lubricating, non-migratory nature of specific forms of silicone additives, such additives can impart lubricity and wear properties to a material similar to that achieved by conventional migratory slip additives without the risk of severe filming in very small concentrations. The enhanced lubricity and wear resistance associated with these additives can reduce photoreceptor drag and extend photoreceptor life.

In addition to reducing drag and wear, other potential benefits of introducing a silicone additive to the surface of the photoreceptor include: decreased photoreceptor belt drag, reduction of the possibility of chatter due to friction, and an increase in the allowable blade angle before chatter and/or blade tuck occurs.

The present invention is similarly directed to reducing frictional forces at a contact region between a system's spots blade and the outermost surface of the photoreceptor. In an effort to reduce the drag caused by friction between the spots blade and the photoreceptor's surface, a silicone additive can be added to a bulk material or surface layer material of the blade during fabrication.

The introduction of silicone additives to the contact regions between photoreceptor's backside anti-curl layer and the system's backer bar and the photoreceptor's outermost layer and the system's spots blade can reduce photoreceptor irregularities, excessive backer bar wear, excessive spots blade wear, belt ripple and belt contamination. Moreover, by reducing the amount of drag and wear occurring at these contact regions, the present invention can also help to minimize torque requirements for driving the photoreceptor.

DETAILED DESCRIPTION OF PREFERRED EMBODIMENTS

Figure 1:
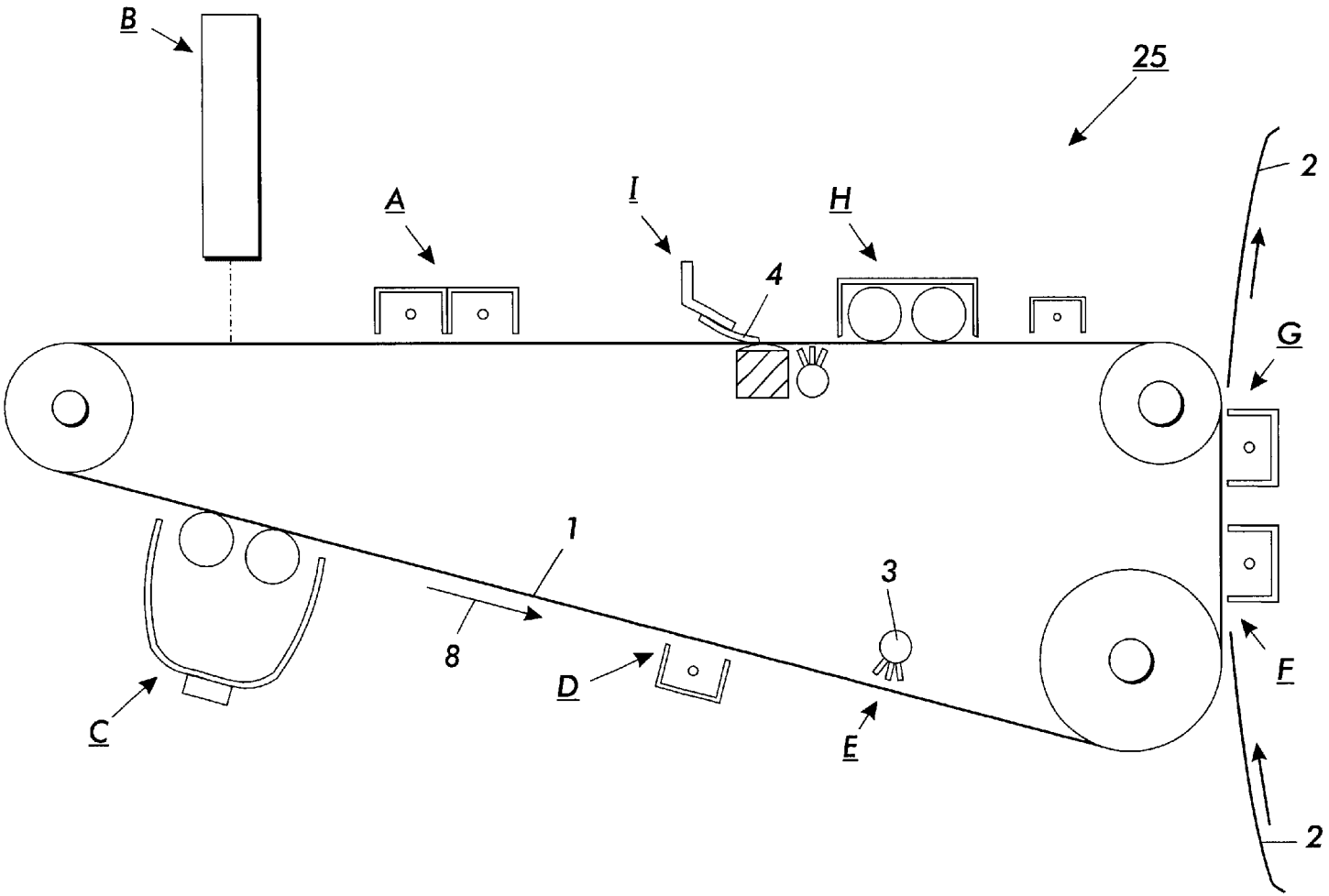
FIG. 1 is a schematic view of one embodiment of a xerographic photoreceptor module.

This invention is directed to the addition of silicone additives to electrophotographic system components to reduce photoreceptor drag and wear. More specifically, the invention involves the addition of such additives to reduce drag and wear at a contact region between a photoreceptor's backside anti-curl layer surface and a system's backer bar or stationary guide surfaces, and/or at a contact region between a photoreceptor's outermost surface and a system's spots blade.

Silicone additives, and particularly spherical silicone additives, are known for their excellent lubricating properties. Specific types of spherical silicone additives that are suitable for the present invention include, but are not limited to, General Electric Corporation's SR340 Series silicone resins and Toshiba Silicone Company's "Tospearl" Series silicone resin particles. The general chemical formulas for these additives are provided in U.S. Pat. No. 5,480,715, to Mills, et al., which is incorporated by reference herein in its entirety.

For example, suitable spherical compounds include, but are not limited to, such particles that comprise a cross-linked three-dimensional network of siloxane linkages, represented by the structures:

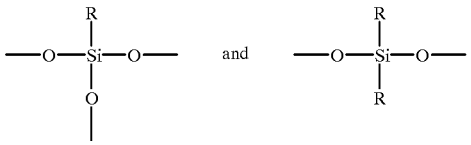

wherein R is an organic group including, but not limited to, an aliphatic hydrocarbon (such as methyl, ethyl, butyl, or the like), an aromatic hydrocarbon (such as a phenyl group), an unsaturated hydrocarbon (such as a vinyl group), or mixtures thereof. Preferably, R is a methyl group.

Other suitable spherical compounds include, but are not limited to, silica-alumina ceramic (such as those produced by 3M Corporation and Polyscience), soda-lime-boroscillcate glass (such as those produced by 3M Corporation and Polyscience), styrene, styrene/methyl methacrylate, styrene/divinyl benzene, styrene/butadiene, styrene/vinyl carboxylate or amino modified styrene (such as those produced by Bangs Laboratories and Dyno Specialty Polymers), carboxylate or amino modified styrene (such as those produced by Bangs Laboratories), styrene and methmethacrylate copolymerized with a variety of functional groups (such as those produced by Polysciences and Dyno Specialty Polymers), polymethylmethacrylate (such as those produced by Bangs Laboratories and Matsumoto), polyvinyl toluene (such as those produced by Bangs Laboratories), various metal oxide based microspheres, phenolic and polyethylene (such as those produced by Brace GmbH), and the like. If desired, mixtures of two or more of the above materials can also be used, in embodiments.

In embodiments of the present invention, the silicone additive can be applied by itself to a desired surface, or it can be applied in combination with a suitable binder material. Preferably, the silicone additive is applied in combination with a suitable binder material. Suitable anti-curl coatings and binder materials include, but are not limited to, the coatings and binders described in U.S. Pat. No. 6,071,662, to Carmichael, et al., which is incorporated herein by reference in its entirety.

Regardless of the particular additive used, the instant invention is aimed at reducing photoreceptor drag and wear at contact regions between the photoreceptor's backside anti-curl layer surface and the system's backer bars or stationary (or other) guide surfaces, and the photoreceptor's outer surface and the system's spots blade. This is achieved by incorporating the silicon additive into one or more of the contact surfaces in the imaging apparatus.

FIG. 1 depicts one embodiment of a xerographic photoreceptor module 25. At stage A a charge is applied to the photoreceptor belt 1, which travels in the direction of arrow 8. At stage B, the photoreceptor 1 is exposed, such as by any conventional exposure means to produce an electrostatic latent image on the photoreceptor belt 1. Toner is then applied to the electrostatic latent image and a toner image is generated at stage C. At stage D the toner is conditioned for transfer to a suitable substrate such as a sheet of paper 2. At stage E the photoreceptor belt 1 is neutralized with a pretransfer lamp 3. At stage F the generated image is then transferred to the paper 2. The paper 2 and the image are then stripped from the photoreceptor belt 1 at stage G. The photoreceptor belt 1 is then conditioned and cleaned to remove residual toner at stage H. Finally at stage I, adherent spots are removed from the photoreceptor belt 1 with a spots blade 4.

Figure 2:
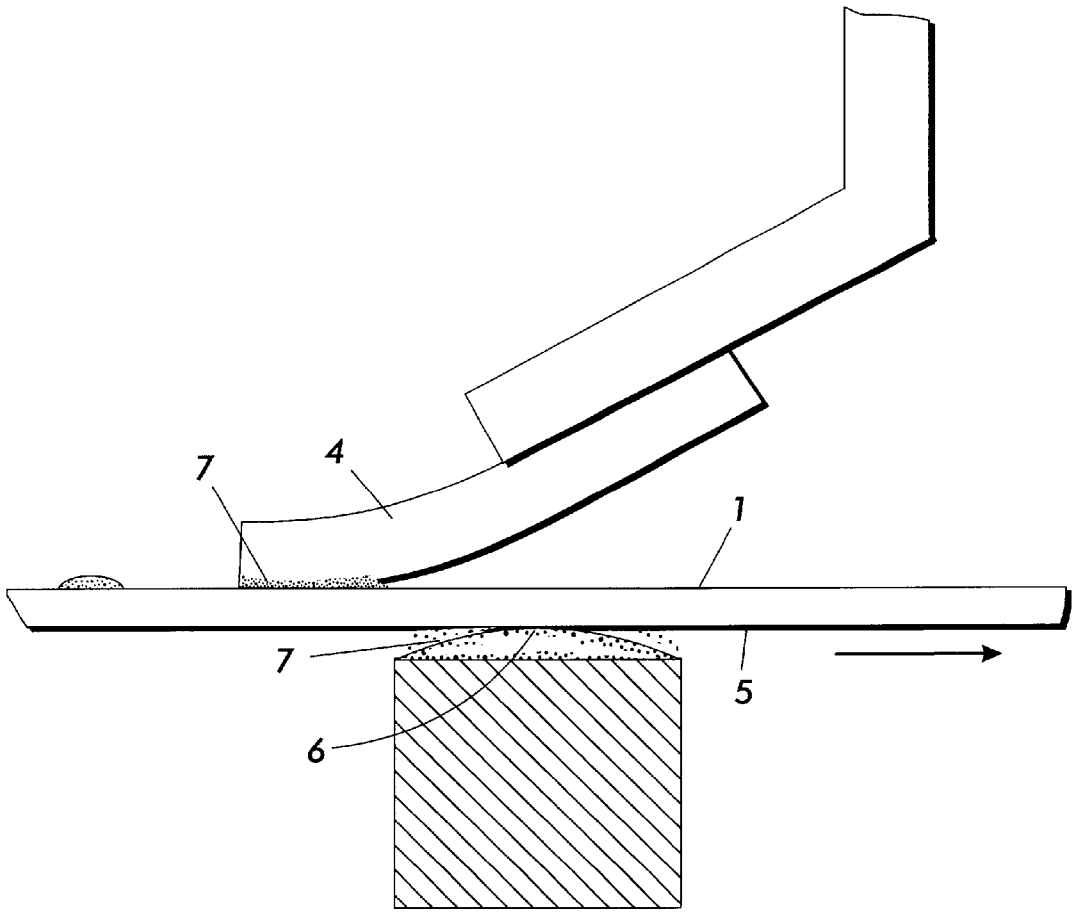
FIG. 2 is a partial schematic view of an exemplary embodiment of a xerographic system according to the invention depicting the orientation of the system's spots blade, backer bar and photoreceptor anti-curl layer.

The present invention is specifically directed to reducing drag and wear that occur during electophotogaphic imaging at stages that correspond generally to stage I, as depicted in FIG. 1. The physical relationships between various system components at stage I are depicted in the partial schematic view of an exemplary embodiment of the instant invention in FIG. 2.

In a first embodiment of the present invention frictional wear and drag that occur at a contact region between the photoreceptor's backside anti-curl layer 5 and the system's backer bar 6 is reduced. Generally, as the photoreceptor belt 1 is cycled, the belt 1 comes in contact with backer bars or stationary guide surfaces 6. The frictional forces generated by the contact between the anti-curl layer 5 and the backer bar 6 can cause photoreceptor surface irregularities, excessive backer bar wear, belt ripple and belt contamination caused by the re-depositing of worn materials on the backer bar 6. Moreover, belt contamination can result in progressively increasing friction that can exceed system drag limits. Furthermore, belt contamination between the backer bar 6 and the anti-curl layer 5 can also adversely affect the photoreceptor's charge transport layer's surface uniformity and can effectively cause "lift" in areas where contamination is severe.

By adding a suitable spherical silicone additive 7 at the contact region between the anti-curl layer 5 (or other bottom layer of the photoreceptor) and the backer bar 6 to serve as a bearing surface, the present invention significantly reduces the friction between the contacting surfaces of these elements. Although there are numerous ways in which a spherical silicone additive 7 may be applied to the contact region between the anti-curl layer 5 and the backer bar 6, one suitable method is to coat the backer bar-contacting surface of the anti-curl layer 5 and/or the anti-curl layer-contacting surface of the backer bar 6 with a suitable silicone additive 7 dispersed in a suitable accompanying binder. According to the present invention, the coating may be applied by any of the known conventional techniques. Although no particular thickness of the coating is preferred, the coating should have a thickness that is effective to provide the above-described objects of the present invention.

Another suitable method of introducing the additive 7 to the contact region between the anti-curl layer 5 and the backer bar 6 is to add the additive 7 to a bulk material of the photoreceptor belt 1 and/or the backer bar 6 during fabrication of the belt 1 and/or backer bar 6, respectively. According to this embodiment of the present invention, the silicone additive is incorporated into the bulk material of the respective imaging apparatus component, rather than being applied only as a coating layer on that component. Although neither method is particularly preferred over the other, a potential advantage of adding the additive 7 to the photoreceptor belt material and/or backer bar material during fabrication is that the additive 7 may be more firmly fixed to the contacting surfaces of the photoreceptor belt 1 and/or backer bar 6 than it would be if it were simply coated onto the contacting surfaces with an appropriate binder. In addition, to provide even greater friction and drag reduction, in a further embodiment of the present invention it is possible to add the appropriate additive 7 to the bulk material of the photoreceptor belt 1 and/or backer bar 6 during fabrication, and then also coat the contacting surfaces with additional additive 7 post-fabrication.

In addition to reducing photoreceptor wear during cycling, an appropriate spherical silicone additive introduced into the contact region between the photoreceptor's backside anti-curl layer 5 and the system's backer bar 6 can also reduce creasing and dimpling of the anti-curl layer that often occurs when the anti-curl layer comes into contact with itself during shipping and storage at elevated temperatures. By reducing the likelihood of creasing and dimpling, an appropriate spherical additive may also reduce the incidence of undesirable aberrations in final printed images that are commonly caused by creasing and dimpling. Moreover, the ability of selected spherical additives to reduce creasing and dimpling may also reduce the need for expensive and elaborate packaging conventionally employed to prevent the anti-curl layer from contacting itself.

According to a further embodiment of the present invention, photoreceptor drag and wear at a contact region between the photoreceptor belt 1 and a spots blade 4 can be reduced. The friction commonly generated at the contact region between the photoreceptor belt 1 and the spots blade 4 can also cause frictional wear and drag problems that are similar to those created by friction at the contact regions between the belt 1 and the backer bar 6. For instance, like the frictional forces produced at the contact region between the belt 1 and the backer bar 6, the frictional forces generated at the contact region between the belt 1 and the spots blade 4 can cause wear failure of the photoreceptor belt 1. The friction-induced wear failure of the belt 1 can manifest itself in the form of photoreceptor surface irregularities, excessive spots blade wear, belt ripple, or belt contamination. As with the belt contamination resulting from frictional forces generated at the contact region between the belt 1 and the backer bar 6, belt contamination resulting from the frictional forces generated at the contact region between the belt 1 and the spots blade 4 can also produce progressively increasing friction that can exceed system drag limits and reduce machine cleanliness.

To reduce the frictional drag and wear at the contact region between the photoreceptor belt 1 and the spots blade 4, a suitable spherical silicone additive 7 is introduced to the contact region between the belt 1 and blade 4. In this case, the additive 7 is added to the bulk material of the spots blade 4 during fabrication. By adding the additive 7 to the bulk of the blade material during fabrication instead of simply coating the blade 4 with additive post-fabrication, the present invention may be able to extend the useful lubricating life of the additive 7. By increasing the lubricating life of the additive 7, the present invention may also be able to extend the useful life of the blade 4 and reduce frictional drag and wear problems otherwise created at the contact region between the belt 1 and the blade 4.

By adding an appropriate spherical silicone additive 7 to the contact regions between the photoreceptor belt 1 and the backer bar 6 and spots blade 4 in accordance with the instant invention, photoreceptor drag and wear can be significantly reduced. Moreover, the reduction of drag and wear at the above-identified contact regions can reduce the severity of photoreceptor surface irregularities, excessive backer bar wear, excessive spots blade wear, belt ripple and belt contamination. Furthermore, by reducing frictional drag and wear at the above-identified contact regions the present invention can minimize system drive torque requirements, extend the life of contacting system components by minimizing wear, and can improve system performance by reducing loose or adherent wear contaminants caused by frictional belt contamination.

Although the present invention has been described above as related to a photoreceptor belt, the present invention is in no way limited to such embodiments. Rather, the principles of the present invention can be applied to a wide range of photoreceptor designs, including but not limited to endless belts, transfer belts (in Intermediate Belt Transfer technology) webs, rollers, drums and the like. For example, in the case of a photoreceptor drum, the above-described frictional wear and drag can result from contact between the inner layer of the drum and a drive means located within the drum. Thus, by providing the silicone additive of the present invention either in the inner layer of the drum or as a coating on that layer, the present invention can likewise be applied to such photoreceptor drums.

Furthermore, while the invention has been described in conjunction with the specific embodiments described above, it is evident that many alternatives, modifications and variations are apparent to those skilled in the art. Accordingly, the preferred embodiments of the invention as set forth above are intended to be illustrative and not limiting. Various changes can be made without departing from the spirit and scope of the invention.

What is claimed is:

1. An electrostatographic imaging apparatus, comprising:

a. an imaging member having an imaging side and a non-imaging side;

b. means for supporting at least a portion of said imaging member, wherein said supporting means contacts the non-imaging side of said imaging member;

c. means for forming an electrostatic latent image on the photoreceptor;

d. means for developing said electrostatic latent image to form a toner image;

e. means for transferring said toner image to a receiving substrate; and f. a spots blade for removing adherent spots or film from said imaging side of said imaging member, wherein said non-imaging side of said imaging member comprises an anti-curl backing layer coated with a silicone additive for reducing drag and wear of said imaging member.

2. The apparatus of claim 1, wherein said silicone additive is a spherical silicone additive.

3. The apparatus of claim 1, wherein said silicone additive is a resin having a network structure with siloxane bonds.

4. The apparatus of claim 1, wherein said silicone additive has a network structure comprising siloxane linkages represented by the following structures:

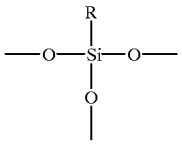

and

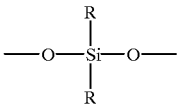

wherein R is an organic group selected from the group consisting of an aliphatic hydrocarbon, an aromatic hydrocarbon, an unsaturated hydrocarbon, and mixtures thereof.

5. The apparatus claim 1, wherein said silicone additive has an average particle size in the range of 0.3 $\mu$m to 12 $\mu$m.

6. The apparatus of claim 1, wherein said silicone additive is also present on a non-imaging side-contacting surface of said supporting means.

7. The apparatus of claim 1, wherein said silicone additive is also included in a bulk material of said supporting means so that said silicone additive is present at a non-imagining side-contacting surface of said supporting means.

* * * * *